US005327918A

United States Patent [19]

Stewart et al.

[11] Patent Number: 5,327,918

[45] Date of Patent: Jul. 12, 1994

[54] MANICURING AID FOR INFANTS AND TODDLERS

[76] Inventors: Christopher O. Stewart; Karen Surprise-Mansfield, both of 222 Kearny St., Suite 500, San Francisco, Calif. 94108

[21] Appl. No.: 859,065

[22] Filed: Mar. 27, 1992

[51] Int. Cl.[5] ..... A45D 29/00

[52] U.S. Cl. ..... 132/73; 128/879; 128/880

[58] Field of Search ..... 132/73, 333; 128/878, 128/879, 880, 882; D28/56, 61; 272/67, 68, 116, 119, 126, 122, 123, 139, DIG. 9; 446/227, 296, 304, 313

[56] References Cited

U.S. PATENT DOCUMENTS

| | | | |
|---|---|---|---|
| D. 100,223 | 6/1936 | Morgan | D8/303 |
| D. 135,041 | 2/1941 | White | 132/73 |
| D. 142,177 | 8/1945 | Walsh | D28/56 |
| D. 158,223 | 4/1950 | Schubert et al. | 132/73 |
| D. 204,183 | 3/1966 | Corlin | D90/11 |
| D. 226,736 | 4/1973 | Benis | D86/10 C |
| 2,223,204 | 11/1940 | Carmichael | 132/73 |
| 2,461,695 | 2/1949 | McMahon | 132/73 |
| 2,546,118 | 3/1951 | Wright | 132/73 |
| 2,662,534 | 12/1953 | Swartz | 132/73 |
| 2,666,340 | 1/1954 | Hunt | 74/551.9 |
| 2,743,727 | 5/1956 | Griesinger | 128/360 |
| 2,798,482 | 7/1957 | Feeney | 128/133 |
| 2,815,679 | 12/1957 | Roberts | 74/551.9 |
| 3,227,455 | 1/1966 | Hulsman | 273/165 |
| 3,565,451 | 2/1971 | Giambazi | 280/11.37 |
| 3,880,443 | 4/1975 | Tobin | 280/11.37 H |
| 3,964,340 | 6/1976 | Antonio et al. | 74/551.9 |
| 4,218,057 | 8/1980 | Wilson | 272/117 |
| 4,296,766 | 10/1981 | Benis | 132/73.5 |
| 4,351,526 | 9/1982 | Schwartz | 272/122 |
| 4,585,017 | 4/1986 | Trujillo | 132/73 |
| 4,928,712 | 5/1990 | Mele | 128/878 |
| 5,060,638 | 10/1991 | Bodine, Jr. | 128/878 |
| 5,076,263 | 12/1991 | Funatogawa | 132/73 |

*Primary Examiner*—Gene Mancene
*Assistant Examiner*—Frank A. LaViola

[57] ABSTRACT

For use with infants and toddlers, an improved manicuring aid has a cylindrical body (10) of semi-rigid plastic with an interior cavity (16). The body has four shallow grooves (28) for guiding and separating the fingertips; two slots (12) and (14) through which an elastic cloth restraining strap (18) for restraining and controlling finger movement is drawn; and two fingertip support ledges (30) and (32) projecting from the body. The strap comprises two hook-and-loop strips (24) and (26) and a doubled strap end (20) which is engaged when drawn through one of the two slots. Multiple support ledges and slots permit the manicuring aid to be grasped in multiple ways. Unrestricted access to the interior cavity facilitates storage, removal, and use of the elastic cloth strap. The manicuring aid does not have small parts which can cause choking or be swallowed.

2 Claims, 4 Drawing Sheets

MANICURING AID FOR INFANTS AND TODDLERS

BACKGROUND—FIELD OF INVENTION

This invention relates to manicuring aids for children, specifically to those that facilitate, promote safety, and expedite fingernail trimming.

BACKGROUND—CROSS-REFERENCE TO RELATED APPLICATIONS

This invention is an improvement of that in our previous U.S. Pat. No. 5,003,997 (to Stewart it al., (1991)) for a manicuring aid for infants employing a comfortable finger movement restraint. This invention improves the function and safety of the device of our previous patent.

BACKGROUND—DESCRIPTION OF PRIOR ART

There are several reasons for keeping infants' and toddlers' fingernails trimmed short. Dirt can get under long fingernails and easily transfer potentially harmful germs to their mouths or to their eyes. With neatly trimmed fingernails, infants and toddlers are less likely to scratch anyone holding them, other children at play, especially at daycare facilities, or themselves, particularly while sleeping.

However, the task of trimming children's fingernails can frequently be difficult, time-consuming, frustrating, and unpleasant for parents and their children. Infants and toddlers have limited motor and muscle control of their hands and often are not willing to tolerate uncomfortable situations, such as someone holding their hands firmly while also spreading their fingers. Children at this age also have a short attention span and some are even afraid of the fingernail trimming activity. Patience and care are required in trimming to ensure a clean, safe cut. Also, a child can be reluctant to have its hand restrained by someone.

If someone attempts to hold a child's hand to trim its fingernails, the child will usually pull its hand away, make a fist, dig its fingers into the palms of its hands, or see the hand-holding as a suggestion for play so that the child refuses to hold still. The person attempting to trim an infant's or toddler's fingernails must often struggle with a child who is wriggling its fingers uncontrollably and trying to pull its hand away. In instances such as these, the risk of trimming the fingernails too short is increased. Also, they may be trimmed crooked leaving jagged edges, or a finger may be pinched or cut, making the child even less receptive in the future. As a result, when their tiny fingernails need to be trimmed, infants' and toddlers' fingers must be restrained and controlled from wriggling. In addition, their fingertips must be spread apart enough to prevent accidentally pinching or cutting a finger with the fingernail clippers, scissors, or other fingernail trimming tool.

One method often used is to have the child grasp one of the fingers of the manicurist, the rail on a baby crib, a nursing bottle, or a similar cylindrical object. This is because it is natural for a child to grip a slender, cylindrical object. Even though a child may voluntarily grasp the object, it will not always continually hold the object by itself. A child will often lose interest or grow tired of grasping the object, despite the fact infants and toddlers are able to instinctively grip by this method. Therefore, its hand must be held in place on the crib rail, nursing bottle, or cylindrical object by the manicurist.

Also, the child's fingers must be prevented from wriggling and its fingertips spread apart enough to prevent accidentally pinching or cutting a finger with the fingernail trimming tool. This requires the manicurist to hold and separate the fingers, and trim the fingernails simultaneously. The manicurist can also try to hold one finger at a time, rather than holding the child's entire hand, isolating the fingernail for trimming. However, the child will often attempt to pull its finger and hand away. Infants and toddlers can also turn their wrists and hands in an attempt to pull away from the manicurist.

Another method is to wait until the child has fallen asleep. By this method, the trimming frequently has to be done in low light, making it difficult to see the tiny fingernails and increasing the risk of pinching or cutting a finger with the fingernail trimming tool, as a result of which the child is painfully awakened.

There have been several types of manicuring devices and related hand grip devices designed in the past. Some provide a handle for gripping. Others attempt to control finger movement and separate the fingertips. Most of the devices are dependent upon the voluntary effort and interest of the subject to continually grasp the devices while they are in use. For example, U.S. Pat. No. 2,223,204 to Carmichael (1940) discloses a manicuring device which provides a finger support, deep grooves that separate the fingers, and a pivoted latch for restraining finger movement. Carmichael's device is used to facilitate the application of fingernail polish. If used with an infant or toddler, the child's fingers have to be inserted into the grooves one at a time, creating the frustration similar to trying to hold one finger at a time to isolate the fingernail for trimming. The preferred embodiment of Carmichael's pivoted latch is made of wire and has a fixed length. To effectively restrain and control finger movement if used with an infant or toddler, the latch would have to be tight and therefore uncomfortable. Also, because the preferred embodiment of the device has a flat shape, a child is still able to make a fist by digging its fingernails into its palms. The wire latch is not adjustable to accommodate various hand sizes and hand growth, nor is it designed for use with infants and toddlers. Finally, the device does not provide a way to store the wire latch if it were to be removed.

U.S. Pat. No. 2,546,118 to Wright (1951) disclose a flat finger restrainer that limits finger movement. Once again, if used with infants and toddlers, their fingers have to be inserted in the finger holes one at a time, again creating the frustration similar to trying to hold one finger at a time to isolate the fingernail for trimming. The holes are not adjustable to accommodate various hand sizes and hand growth. While holding the device, a child is still able to easily make a fist by digging its fingernails into its palms. The devices separate the fingers, but do not restrain and control finger movement, thereby increasing the risk of accidentally pinching or cutting a finger.

U.S. Patent Des. 142,177 to Walsh (1945) and U.S. Pat. No. 2,461,695 to McMahon (1949) disclose flat manicuring accessory devices to be gripped by the hand. These require the user to grasp the devices by bending the fingers and thumb at the first knuckle nearest the fingertip. An infant or toddler, because of its limited motor and muscle control, cannot adequately grasp the device, and there is nothing to restrain and control finger movement.

U.S. Patent Des. 226,736 to Benis (1973) discloses a finger manicuring grip which provides a shape which can be easily grasped by infants and toddlers if it were sized for their tiny hands. Moreover, using this device with an infant or toddler requires the manicurist to hold their fingers on the device while simultaneously trying to trim their fingernails because there is nothing to restrain and control finger movement.

U.S. Patents Des. 158,223 to Schubert et al (1950), U.S. Pat. No. 2,662,534 to Swartz (1953), U.S. Pat. No. 4,296,766 to Benis (1981), and U.S. Pat. No. 4,585,017 to Trujillo (1986) all disclose manicuring devices which support the hand or fingers to facilitate the application of fingernail polish. They support and spread the fingers but do not provide anything to restrain and control finger movement. The devices are dependent upon the voluntary effort and interest of the subject to hold their hand in place in the devices while they are in use. The preferred embodiments of the devices are not cylindrical in shape and therefore not easy for infants and toddlers to grasp.

U.S. Pat. No. 2,798,482 to Feeney (1957) discloses an infant accessory device comprising a handle for gripping, but without a way to separate the fingers and consequently the fingertips. The device attaches to an infant's hand by means of an elastic strap of fixed length that is not adjustable, thereby limiting the ability o the device to accommodate various hand sizes and hand growth. The strap also fits over the back of an infant's hand and does not separate the fingers nor restrain and control finger movement. In the preferred embodiment of Feeney's device, the handle for gripping is small enough to permit an infant grasping it to dig its fingertips into its palms. Finally, the device does not provide any way to store the strap if it were to be removed.

U.S. Pat. No. 2,743,727 to Griesinger (1956) also discloses an infant accessory device to be used primarily as a teething device or pacifier. It has a handle with a bulbous end to facilitate grasping, but does not have anything to separate the fingers or restrain and control finger movement.

U.S. Patents Des. 100,223 to Morgan (1936), U.S. Pat. No. 2,666,340 to Hunt (1954), U.S. Pat. No. 2,815,679 to Roberts (1957), Des. 204,183 to Corlin (1966), and U.S. Pat. No. 3,964,340 to Antonio et al (1976) disclose hollow cylindrical hand grip devices designed for bicycles. All of the devices are dependent upon the voluntary effort and interest of the subject to continually grasp the devices while they are in use. While the devices have ridges which separate the fingers and can be easily grasped by infants and toddlers, there is nothing which restrains and controls finger movement. In the preferred embodiments of the devices, the subjects need the ability to freely move the hands and fingers, and therefore finger movement restraints would be unsafe.

U.S. Pat. No. 4,218,057 to Wilson (1980) discloses a hand grip device to be used during aerobic exercise. Wilson's device has ridges to facilitate gripping and a looped cord which circles the wrist loosely to prevent the device from falling from the hand when it is in use. The cord is not adjustable and does not restrain and control finger movement.

U.S. Pat. No. 4,351,526 to Schwartz (1982) discloses another hand grip device to be used during aerobic exercise. Schwartz's device has ridges to separate the fingers and to facilitate gripping. The device also employs a strap of fixed length and limited adjustment to prevent the device from falling from the hand during use. The strap passes over the back of the subject's hand between the knuckles and the wrist and therefore does not control finger movement. The strap may only be adjusted by predetermined intervals. This limits its ability to accommodate various hand sizes and hand growth, as well as varying degrees of restraint. The device does not provide any way to store the strap if it were removed.

U.S. Pat. No. 3,227,455 to Hulsman (1966) discloses a golf club grip having deep finger grooves and a guard element. The grooves separate the fingers, but there is nothing to restrain and control finger movement. The rigid guard of fixed length passes over the knuckles and allows adequate clearance to easily slip the hands in and out of the finger grooves.

U.S. Pat. No. 3,565,451 to Giambazi (1971) discloses a ski pole grip with ridges to separate the fingers and facilitate gripping, and an adjustable strap to hold the ski pole to the skier's hand. The strap, however, allows finger movement for better control of the ski pole. If the grip is held properly, the strap passes over the fingers on the back of the first phalanges bone of the fingers and does not restrain and control finger movement. In the preferred embodiment of the device, its shape is not cylindrical and therefore it is difficult for infants and toddlers to grasp. Finally, the device does not provide a way to store the strap if it were removed.

U.S. Pat. No. 3,880,443 to Tobin (1975) discloses another ski pole grip. Tobin's ski pole grip has ridges which separate the fingers to facilitate gripping, but is dependent upon the voluntary effort and interest of the subject to continually grasp the device while it is in use. A molded portion of the grip, designed for quick exit of the hand from the device, presses against the back of the skier's hand. This portion simulates a strap but does not restrain and control finger movement.

Our own U.S. Pat. No. 5,003,997 discloses a hand grip device specifically designed for infants and toddlers. However, infants and toddlers must be coerced to grasp the device in one particular manner for it to be effective. This causes its potential to be less than optimal. The device has a strap for controlling finger movement, but in the preferred embodiment, it is glued to the device at one end, further limiting its potential. In addition, it has a cavity enclosed at one end by a wall. This restricts access to the cavity to only one end. As a result, if the strap is stored in the cavity and is pushed in too far, removing it from the cavity is difficult. Moreover, the device is unsafe because it has a small removable cap on which infants and toddlers can choke. It also has small parts which can break off and be swallowed.

In summation, all the manicuring aids and hand grip devices heretofore known suffer from a number of disadvantages:

(A) They are designed as manicuring accessories to facilitate fingernail polish application for mature persons with hands larger than those of infants and toddlers, as hand grip devices for bicycle handle bars, as hand grip devices to be used during aerobic activity, or as hand grip devices to aid in the control and maneuvering of ski poles. The devices are not designed as manicuring aids for use with infants or toddlers nor to placate them. The unpleasing shape and the coercion necessary to apply them to infants and toddlers serves to make children more reluctant to the fingernail trimming activity.

(B) The devices are not designed to allow a child to grip naturally or otherwise keep the hand in a natural, comfortable position. This increases a child's reluctance to experience the fingernail trimming activity.

(C) To be effective, the devices are dependent upon the voluntary effort and interest of the subject to continually grasp the devices while in use. Infants and toddlers have short attention spans and will not grasp the devices long enough nor hold their fingers steady enough to permit their fingernails to be trimmed.

(D) The devices cannot restrain and control finger movement, especially with different hand sizes.

(E) When the devices are applied to an infant or toddler, the manicurist must hold and separate the fingertips and trim the fingernails simultaneously, which is a different task.

(F) The devices do not provide a way to store the components of the devices, such as the manicuring accessories or ski pole grip straps.

(G) The devices require the subject to employ or grasp the devices in one particular manner or they are rendered ineffective.

OBJECTS AND ADVANTAGES

Several objects and advantages of the present invention are:

(A) To provide a manicuring aid designed to be used with infants and toddlers as an aid to facilitate, expedite, and make safer the trimming of their tiny fingernails, and encourage them to have a more pleasurable association with the fingernail trimming activity.

(B) To provide a manicuring aid that can distract children's attention away from the fingernail trimming activity, the fingernail clippers, and the fact the fingers are being restrained and controlled.

(C) To provide a manicuring aid which encourages and accommodates infants' and toddlers' natural, albeit limited, ability to grip an object in a comfortable manner, thereby making the fingernail trimming activity less fearful and not dependent upon the children continually grasping the device.

(D) To provide a manicuring aid which does not require infants' and toddlers' voluntary effort and interest to continually grasp the device while it is in use.

(E) To provide a manicuring aid with an adjustable means of comfortably yet firmly restraining and controlling infants' and toddlers' fingers, and therefore, fingertip movement as well as accommodating different hand sizes.

(F) To provide a manicuring aid which separates infants' and toddlers' fingertips and holds them apart during the fingernail trimming activity to relieve the manicurist of the frustrating necessity of having to hold the fingers steady and the fingertips apart while simultaneously attempting to trim the fingernails.

(G) To provide a manicuring aid with a means for storing the fingernail trimming tool and components of the manicuring aid when not in use.

(H) To provide a manicuring aid which may be grasped in more than one manner by infants and toddlers without impairing its effectiveness.

Further objects and advantages are to provide a manicuring aid that is small and portable; that is lightweight and easy for a child to hold; that, due to its simple design and use of material, is inexpensive to manufacture; that is interchangeable between the right and left hands; that is easy to clean with soap and water; that may serve as a toy because its shape may be incorporated in a larger form; that is made of non-toxic materials so it is safe; and that has no small pieces which may break off and be swallowed. Still further objects and advantages will become apparent from a consideration of the following description and drawings.

DRAWING FIGURES

In the drawings, closely-related figures have the same numbers but different alphabetic suffixes.

REFERENCE NUMERALS IN DRAWINGS

Figure 1:
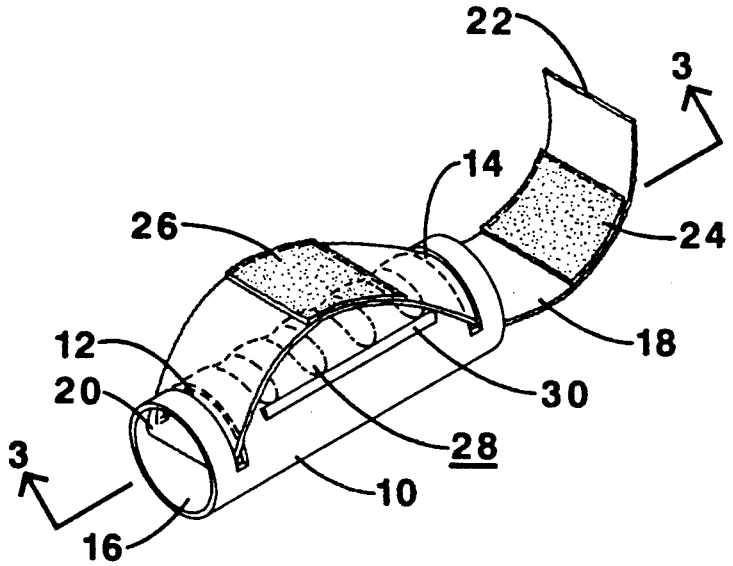
FIG. 1 is a perspective view looking at one end of a manicuring aid in accordance with a preferred embodiment of the present invention.

10: body
12: slot
14: slot
16: interior cavity
18: elastic restraining strap
20: doubled strap end
22: strap end
24: hook-and-loop strip
26: hook-and-loop strip
28: four shallow grooves
30: fingertip support ledge
32: fingertip support ledge
34: child's hand
36: fingernail clippers
38: manicurist's hand

DESCRIPTION—FIGS. 1, 2, AND 3

Figure 2:
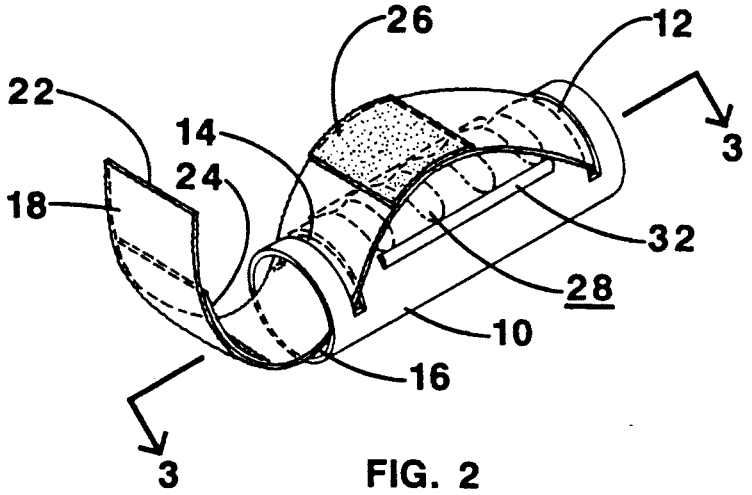
FIG. 2 is a perspective view looking at the other end of the same device.

A typical embodiment of a manicuring aid for infants and toddlers according to the present invention is illustrated in FIGS. 1 and 2 (perspective views). The manicuring aid comprises a hollow cylindrical barrel or body 10, open at each end. In the preferred embodiment, the body is approximately 83 mm (3.3 inches) in length, has a diameter of approximately 31 mm (1.25 inches), and a thickness of 1.5 mm (0.0625 inch). Body 10 is a pliable, semi-rigid, non-toxic plastic, such as polyethylene or polypropylene. However, other pliable, semi-rigid, non-toxic plastics may be used.

An elastic restraining strap 18 is stored within an interior cavity 16, as illustrated in FIGS. 1 and 2. The cavity protects strap 18 from becoming soiled or lost. If desired, a fingernail cutting tool (not shown) may also be stored in cavity 16, thereby keeping the manicuring aid accessories together. Strap 18 is elasticized cloth and is approximately 163 mm (6.5 inches) in length and 25 mm (1 inch) wide.

Figure 3:
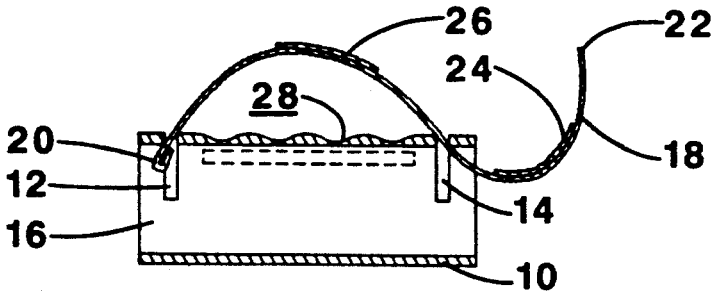
FIG. 3 shows a longitudinal sectional view of the manicuring aid taken as indicated by line 3—3 in FIGS. 1 and 2.

As illustrated in FIGS. 1 and 3, approximately 6 mm (0.25 inch) of strap 18 is folded over at doubled strap end 20 so that it becomes twice the thickness of strap 18 and opposite strap end 22. Doubled strap end 20 is glued with non-toxic adhesive and/or sewn to the remainder of strap 18 to hold it in place. At one side of strap 18 are mating hook-and-loop strips 24 and 26, such as sold under the trademarks VELCRO and LATCHLOCK. Each strip is approximately 25 mm (1 inch) in length and as wide as strap 18. Strips 24 and 26 are glued with non-toxic adhesive and/or sewn to strap 18; on strip 24 the glued part starts at approximately 19 mm (0.75 inch) from strap end 22, and on strip 26, 38 mm (1.5 inches) from strip 24.

Located approximately 6 mm (0.25 inch) from each end and slicing through the same demicylinder of body 10 into interior cavity 16 are slots 12 and 14, as illustrated in FIGS. 1, 2, and 3. Slots 12 and 14 are oriented orthogonally about the longitudinal axis and are approximately 3 mm (0.125 inch) wide and have an arc length equal to approximately one half the circumference of body 10. Slots 12 and 14 at each end of body 10 permit elastic restraining strap 18 to be inserted through either slot 12 or slot 14. As a result, the manicuring aid may be grasped by infants and toddlers in more than one manner.

Integral to body 10 as illustrated in FIGS. 1, 2, and 3 are four shallow grooves 28 that act as finger guides. Grooves 28 are similar to the grip on a bicycle handlebar. They separate the fingers of infants' and toddlers' hands when grasping the manicuring aid. Grooves 28 are oriented orthogonally to body 10 in the same demicylinder of body 10 as slots 12 and 14 and have an arc length of approximately 27 mm (1.06 inches) and a width of approximately 8 mm (0.31 inch).

Integral to body 10, oriented symmetrically about the longitudinal axis of body 10, and located perpendicular to and at each end of grooves 28 are fingertip support ledges 30 and 32, as shown in FIGS. 1 and 2. Support ledges 30 and 32 project from body 10 approximately 2 mm (0.06 inch) and are approximately 52 mm (2.06 inches) long so as to extend the length of grooves 28, as shown in FIGS. 1 and 2. Ledges 30 and 32 support the fingertips when the fingers of infants' and toddlers' hands are in grooves 28. Ledges 30 and 32 at each end of grooves 28 permit the manicuring aid to be grasped by infants and toddlers in more than one manner. Thus their fingertips are supported when the fingers are in grooves 28.

OPERATION—FIGS. 4A TO 4E

Figure 4A:
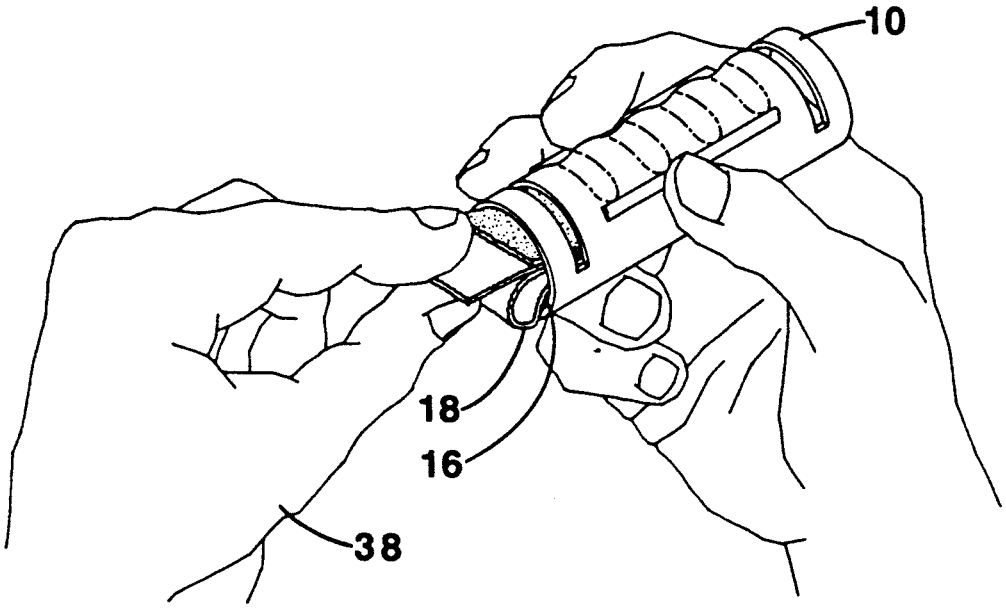
FIGS. 4A to 4E show perspective views illustrating use of the manicuring aid.
Figure 4B:
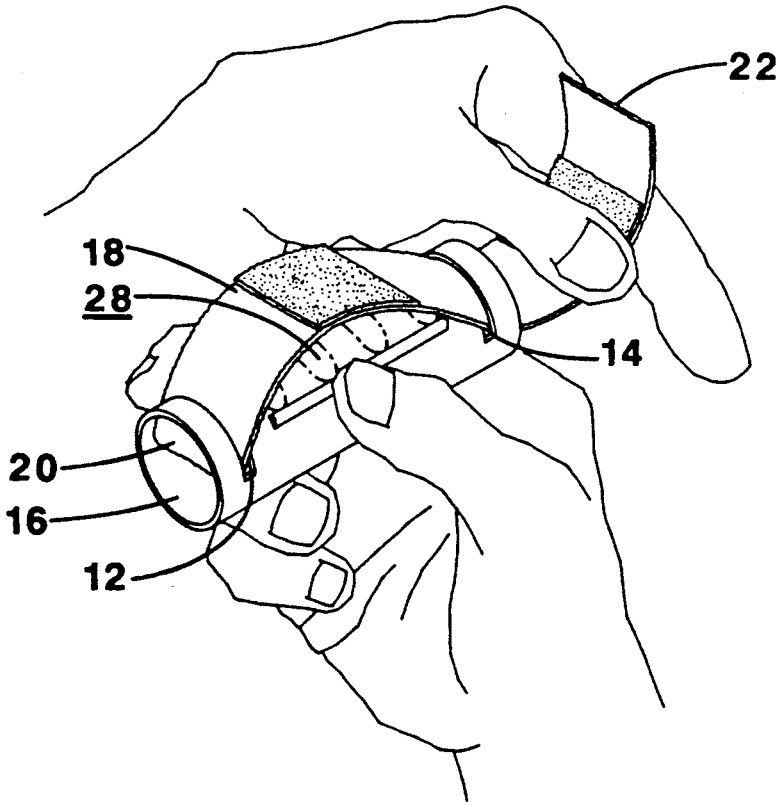

The following description assumes that the manicuring aid is used with an infant's or toddler's left hand. The manicuring aid is equally applicable to the right hand. FIGS. 4A and 4B illustrate how the manicuring aid is readied for use.

As shown in FIG. 4A, body 10 is held in one of the manicurist's hands while the manicurist's other hand 38 extracts strap 18 by pulling or pushing it out of interior cavity 16 where it is stored when not in use.

End 22 of strap 18, with hook-and-loop strips 24 and 26 facing up, is inserted up through slot 12 from cavity 16 and drawn across four shallow grooves 28 to slot 14. Then it is inserted down through slot 14 to interior cavity 16 and drawn out through the open end of body 10, as shown in FIG. 4B. Strap 18 cannot be pulled completely through slot 12 because doubled strap end 20 is thicker than the opening of slot 12.

Figure 4C:
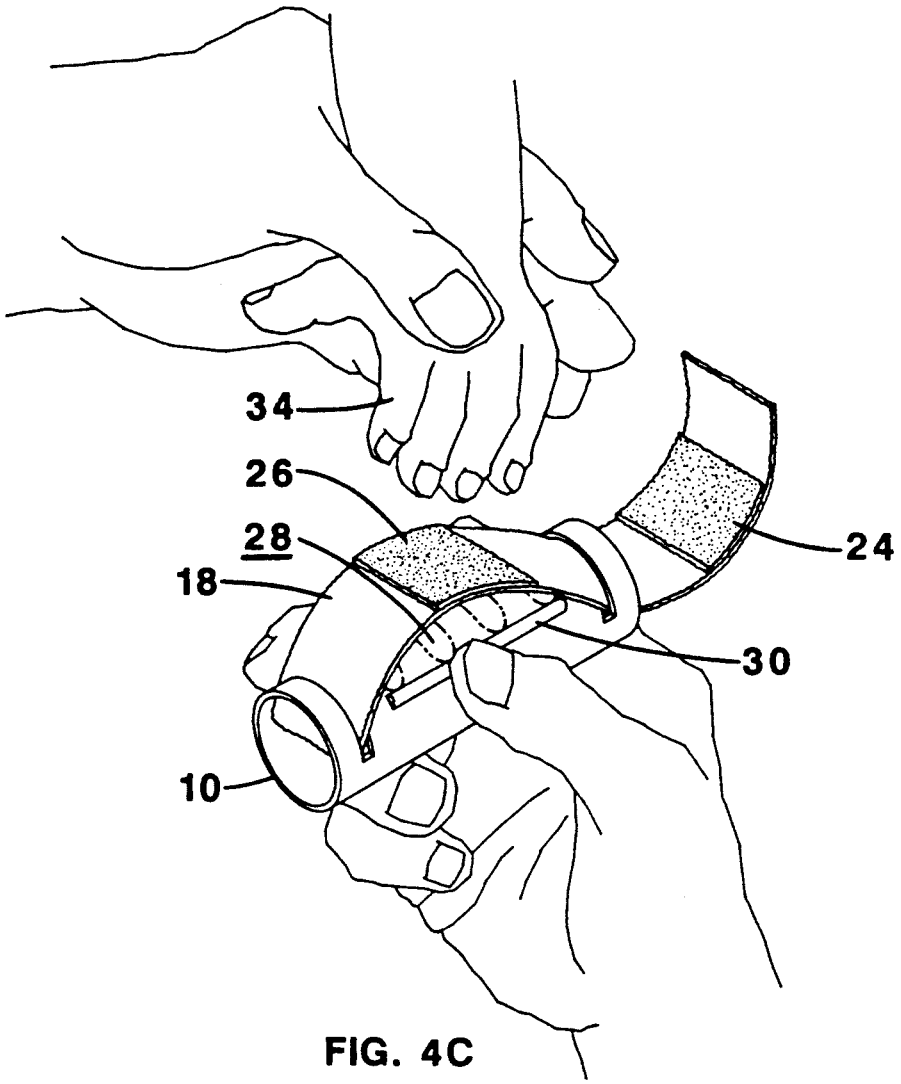

After strap 18 is in place, the manicuring aid is attached or assembled to a child's hand 34, as illustrated in FIG. 4C. The manicurist takes hold of hand 34 in one hand and the manicuring aid in the other. Hand 34 is then guided between strap 18 in its flaccid state and body 10. The fingers of hand 34 are placed in grooves 28, with the fingertips on support ledge 30.

Figure 4D:
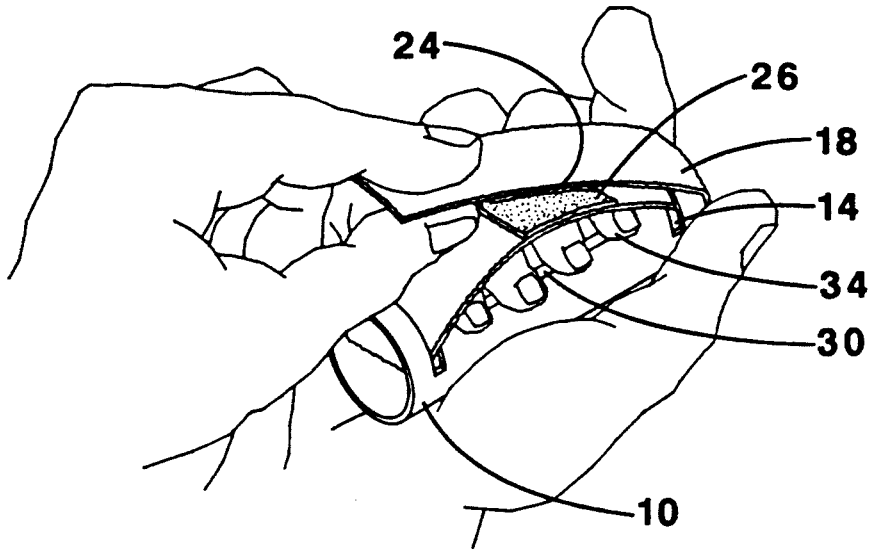

Due to the tendency of the child to grasp the manicuring aid, the thumb will either wrap around body 10 opposite the fingers or will move about freely. This does not affect the other fingertips because they are separated from each other and the thumb is separated from the other fingers. The manicurist uses one hand to hold hand 34 which in turn grasps the manicuring aid. The manicurist's other hand is free to tighten strap 18, as shown in FIG. 4D. Strap 18 may be tightened by further pulling it through slot 14, drawing it up and over the respective end of body 10, and then back over itself and the fingers. When strap 18 is tight enough to restrain and control movement of the fingertips without causing the child discomfort, hook-and-loop strip 24 is pressed to hook-and-loop strip 26 to hold strap 18 in place. Tension adjustments are made by separating strips 24 and 26 and pressing them together again once the desired tension is attained. To adjust separation of the fingertips, the manicurist spreads the fingertips apart or closer together while strap 18 is in place.

Figure 4E:
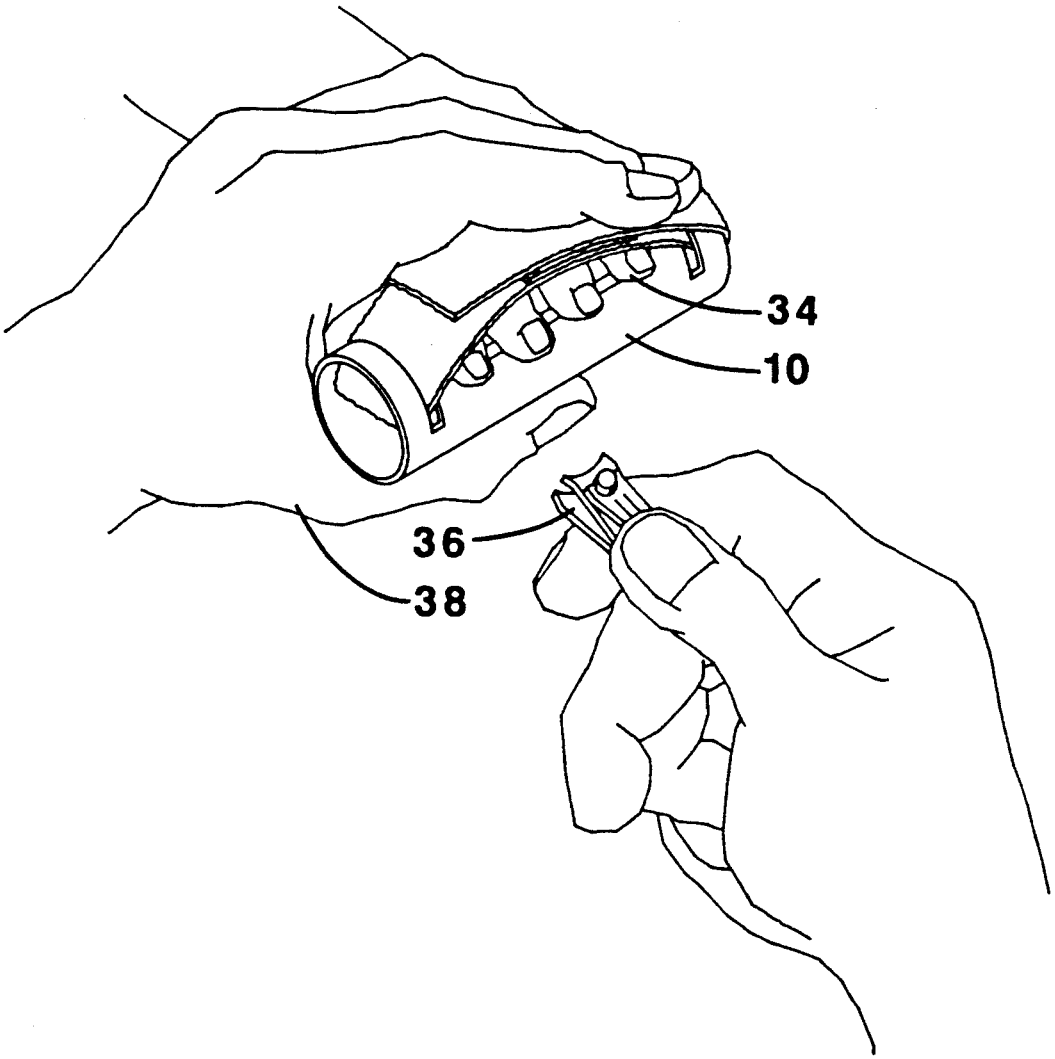

FIG. 4E illustrates the fingernail trimming activity. Child's hand 34 with the manicuring device is held in one of the manicurist's hands 38 while the manicurist's other hand trims the fingernails with fingernail clippers 36. The fingernail of the thumb is trimmed by pressing it to body 10, or by holding it between the manicurist's thumb and forefinger and trimming the fingernail.

After the fingernails have been trimmed, strips 24 and 26 are separated, thereby releasing tension on strap 18, and child's hand 34 is removed from the manicuring aid. The above operation is then repeated for the other hand.

When the fingernail trimming activity has been completed and hand 34 has been removed from the manicuring aid, strap 18 is withdrawn through slots 14 and 12 and pushed into cavity 16 for storage until future use.

Since the manicuring aid has multiple fingertip support ledges adjacent the finger grooves, infants and toddlers can grasp it in multiple ways. In addition, since the manicuring aid also has a slot at each end, the doubled end of the strap effectively eliminates the need to affix the strap to the body, leaving it free to be inserted form either end.

Since the cloth strap is elastic, when it is rolled or folded and pushed into the cavity of the manicuring aid for storage, it naturally uncoils to the limit of the cavity. Friction created by the strap and the walls of the cavity holds it inside. The strap can also be rolled or folded around the fingernail clippers and pushed into the cavity where it naturally uncoils to the limit of the cavity holding both components inside.

Removal of the strap from the cavity is facilitated by the fact the body is open at opposite ends permitting unrestricted access to the cavity. With opposite ends of the body open, the strap cannot be pushed into the cavity so that it becomes difficult to remove. The strap is simply pushed out of the cavity at either end.

Finally, the manicuring aid is safer for infants and toddlers because it is a single-molded device. It does not have small removable parts which they can put in their mouths and choke on, nor does it have small parts which can break off and be swallowed.

SUMMARY, RAMIFICATIONS, AND SCOPE

Accordingly, the reader will see that the manicuring aid of this invention can be used to facilitate and expedite the trimming of infants' and toddlers' fingernails. Furthermore, the manicuring aid has the additional advantages in that:

it provides a manicuring aid tailored to the small size of infants' and toddlers' hands.

it provides a manicuring aid which has a simple shape thereby being inexpensive to manufacture.

it provides a manicuring aid which is naturally and easily held in infants' and toddlers' hands in a natural grasping manner.

it provides finger grooves which separate the fingertips and holds them apart for safer and easier fingernail trimming, thereby relieving the manicurist of the frustrating necessity of holding the fingers apart while simultaneously attempting to trim the fingernails.

it provides a small platform which slightly raises the fingertips from the device when an infant or toddler is grasping the device to facilitate fingernail trimming.

it provides a manicuring aid which, when attached to an infant's or toddler's hand, does not require the manicurist to hold the manicuring aid in place.

it provides a manicuring aid with an elastic strap which allows for various hand sizes and hand growth, and permits the adjustment of the tension required to restrain and control finger movement so the hand may be comfortably restrained.

it provides a manicuring aid with slots which are used for guiding and securing the adjustable strap and as leverage to increase or decrease the tension of the strap.

it provides a manicuring aid which permits convenient storage of the fingernail trimming tool and components of the manicuring aid within the device when not in use thereby keeping them clean and together for easy retrieval in the future.

it provides a manicuring aid which allows the manicurist to concentrate on trimming the fingernails, rather than struggling with an infant's or toddler's hand, thereby minimizing the chances of accidentally pinching or cutting a finger with the fingernail trimming tool.

it provides a manicuring aid that is safe because it does not have small pieces which can cause choking or be swallowed by infants and toddlers.

Although the above description contains many specificities, these should not be construed as limiting the scope of the invention but as merely providing illustrations of some of the presently preferred embodiments of this invention. For example, the appearance of the manicuring aid can vary in shape and color without affecting the function of the device. It may be oval, rectangular, or barrel-shaped. The raised support ledges may be larger or more numerous. The elastic restraining strap may be narrower or wider. In addition, the end of the elastic restraining strap may be removably attached to the device. The cavity may also be enclosed in some way. Moreover, the manicuring aid can be made from a variety of materials without impairing its effectiveness. Accordingly, the scope of the invention shoulder be determined not by the embodiment illustrated, but by the appended claims and their legal equivalents.

We claim:

1. A manicuring aid for controlling the finger movement of infants and toddlers to facilitate trimming said infants' and toddlers' fingernails, comprising: a cylindrical barrel, said barrel being made of a resilient, pliable, plastic material, said barrel having a cavity and opposite ends which are open so as to permit access to said cavity, said barrel having a longitudinal axis, a plurality of substantially parallel finger grooves, and a plurality of fingertip support ledges, said finger grooves extending between and normal to said ledges, an elastic cloth strap, and a plurality of slots cut into said cylindrical barrel on opposite sides of said finger grooves.

2. A manicuring aid for controlling the finger movement of infants and toddlers to facilitate trimming said infants' and toddlers' fingernails, comprising: a cylindrical barrel, said barrel being made of a resilient, pliable, plastic material, said barrel having a cavity and opposite ends which are open so as to permit access to said cavity, said barrel having a longitudinal axis and four substantially parallel finger grooves, said grooves being oriented orthogonally to said longitudinal axis, said grooves being longitudinally spaced along one side of said barrel, said barrel having two fingertip support ledges, one of each of said support ledges located at each side of said barrel at the ends of said finger grooves, said support ledges being oriented parallel to said longitudinal axis, said support ledges protruding radially outward form said barrel and being circumferentially spaced around said barrel, said finger grooves extending between and normal to said ledges, an elastic cloth strap, and a plurality of slots cut into said cylindrical barrel on opposite sides of said finger grooves.

* * * * *